US008424120B2

(12) United States Patent
Steingrube et al.

(10) Patent No.: US 8,424,120 B2
(45) Date of Patent: Apr. 23, 2013

(54) DEVICE AND PROCESS FOR COOLING A SAFETY SUIT

(75) Inventors: Kim Sascha Steingrube, Steinhorst (DE); Jochim Koch, Ratzeburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 742 days.

(21) Appl. No.: 12/608,416

(22) Filed: Oct. 29, 2009

(65) Prior Publication Data

US 2010/0138982 A1 Jun. 10, 2010

(30) Foreign Application Priority Data

Dec. 5, 2008 (DE) ..... 10 2008 060 826

(51) Int. Cl.
*A41D 13/05* (2006.01)

(52) U.S. Cl.
USPC ..... 2/458

(58) Field of Classification Search ..... 2/458, 102, 2/69, 97, DIG. 3, 81, 456, 84; 62/259.3, 62/201
See application file for complete search history.

(56) References Cited

U.S. PATENT DOCUMENTS

| | | | | |
|---|---|---|---|---|
| 3,174,300 | A | 3/1965 | Webb | |
| 3,570,264 | A * | 3/1971 | Curtis | 62/259.3 |
| 4,780,117 | A * | 10/1988 | Lahey et al. | 62/4 |
| 5,201,365 | A * | 4/1993 | Siegel | 165/46 |
| 5,539,934 | A * | 7/1996 | Ponder | 2/413 |
| 6,125,645 | A * | 10/2000 | Horn | 62/259.3 |
| 6,957,697 | B2 * | 10/2005 | Chambers | 165/297 |
| 7,107,629 | B2 * | 9/2006 | Miros et al. | 2/458 |
| 7,681,249 | B2 * | 3/2010 | Oliver et al. | 2/102 |
| 7,827,624 | B1 * | 11/2010 | Cole | 2/458 |

FOREIGN PATENT DOCUMENTS

| | | |
|---|---|---|
| DE | 30 04 595 A1 | 8/1981 |
| DE | 28 46 139 C2 | 12/1982 |
| EP | 1 494 760 B1 | 10/2005 |

* cited by examiner

*Primary Examiner* — Danny Worrell

(74) *Attorney, Agent, or Firm* — McGlew and Tuttle, P.C.

(57) ABSTRACT

A cooling device for a safety suit, including an air delivery device (2) and a cooling source (3), has a substance that reacts endothermically with water as the cooling medium.

18 Claims, 3 Drawing Sheets

DEVICE AND PROCESS FOR COOLING A SAFETY SUIT

CROSS REFERENCE TO RELATED APPLICATIONS

This application claims the benefit of priority under 35 U.S.C. §119 of German Patent Application DE 10 2008 060 826.2 filed Dec. 5, 2008, the entire contents of which are incorporated herein by reference.

FIELD OF THE INVENTION

The present invention pertains to the air conditioning of a safety suit, as it is used in the chemical industry or in disaster missions. The safety suit shields the body of the user of the suit together with his or her respirator against the ambient atmosphere, so that an air volume insulated from the ambient atmosphere is present between the user of the suit and the safety suit.

BACKGROUND OF THE INVENTION

The physiological stress for the users of safety suits is very high because the temperature and humidity rise very rapidly in the suit during physical exertion. The high humidity of the air, in particular, has the consequence that the user cannot sufficiently release his or her body heat any longer, since the heat is released mainly by sweating during physical exertion. The mission of rescue teams using safety suits is very limited in time due to this circumstance and the mission time is therefore only 20 minutes to 30 minutes, maximum. Only little time and energy are left for the rescue mission proper and the return if long distances are to be covered to reach the mission site.

Humans are definitely capable of performing physical activity over several hours even at ambient temperatures of 42° C. if the humidity of the air is relatively low, i.e., below 30% relative humidity. Even though the body temperature does rise somewhat in the process, it will then remain at a stable level. This also applies to the heart rate.

The body temperature rises steadily and the test subject will become exhausted very rapidly at a markedly reduced air temperature of 32° C. but a very high relative humidity of 84%. The circumstance that exhaustion is accelerated in persons who use a safety suit by the fact that a respirator also must be carried by the person besides the safety suit is to be taken into consideration.

A safety suit, in which air is fed into the safety suit by means of a blower from the outside and is released from the safety suit via a pressure relief valve, is known from EP 1 494 760 B1. Even though a measurable cooling effect is obtained due to the rinsing with air, moisture cannot be prevented from becoming enriched in the interior space of the suit and from being condensed on the material of the safety suit. The condensate collects partially on the clothing, which is unpleasant for the user of the suit. In addition, the blower draws in ambient air, which may be contaminated and must be thoroughly filtered. The residual risk that contaminated air may enter the interior space of the safety suit is not accepted by the users.

Liquid cooling is also used to cool a person or to regulate the person's temperature. This is used in space suits, but also in chemical safety suits. However, this principle has limited effect because it acts directly on the skin on the basis of the conductive cooling effect. The skin temperature must be kept so cool that no sweating occurs and this leads as a result to nonphysiological or very unpleasant, cold skin temperatures. The cooling source proper is arranged, besides, outside the suit. The entire cooling energy must be carried along in case of a mobile device, which leads to heavy weights of about 12-18 kg additionally and to a correspondingly large overall volume. Water ice storage units carried along have corresponding net weights of 3.23 kg for the ice plus the own weight of the housing for a hypothetical cooling energy of 1,080 kJ, which corresponds to a cooling capacity of 800 W over 30 minutes. The handling of water ice is cumbersome because the ice must first be made and finally removed from the cooling containers and introduced into the cooling device. A safety suit with a cooling source appears, for example, from DE 28 46 139 C2.

A safety suit, in which the air of the interior space is circulated by means of a blower and both carbon dioxide and moisture are removed in the process, is known from U.S. Pat. No. 3,174,300. The oxygen consumed is replaced. A chamber filled with a coolant is used to separate moisture, and the condensate formed is collected in a collection tank. A coolant must be carried along and replaced after a certain use time. The cooling energy available is greatly limited due to the weight of the coolant carried along.

SUMMARY OF THE INVENTION

The basic object of the present invention is to propose a device and a process for achieving the air conditioning of the interior space of a safety suit in a simple manner.

According to the invention, a device is provided for cooling the interior space of a safety suit. The device comprises an air delivery device providing an air volume flow for circulating air in the interior space. A cooling source with a heat exchanger is arranged in the air flow and with a reservoir connected to the heat exchanger. A substance reacting endothermically with water is provided. The substance is provided in the reservoir.

The substance may advantageously consist essentially of one of ammonium nitrate, ammonium chloride, potassium chloride and common salt.

The device may advantageously further comprise a container, a connection line with a valve, provided between the container and the reservoir, the connection line being closed or opened by the valve, and water. The water is contained in the container and is separated from the substance by the connection line with the valve.

The air volume flow of the air delivery device may advantageously be set at a value between 500 L per minute and 1,000 L per minute.

The device may advantageously further comprise a mounting plate for fastening on the back of a user of the suit, the air delivery device and the cooling source being arranged on the mounting plate. A respirator compressed gas cylinder may advantageously be fastened to the mounting plate.

An air discharge opening of the air delivery device may be directed towards the head of the user of the suit.

Provisions are made according to the present invention for using salts reacting endothermically with water as the cooling medium, which can be easily stored, on the one hand, and do not cause a disproportionate increase in the weight to be carried along by the user of the suit. Even though endothermically reacting substances as cooling sources of cooling vests have been known, DE 30 04 595 C2, it was found that the cooling energy available can be utilized substantially more efficiently when an air delivery device is used, which circulates the air in the interior space of the safety suit, than when the substance is arranged in small bags on the surface of the cooling vest only.

The suitable salts are ammonium nitrate, ammonium chloride, potassium chloride or common salt. Cooling mixtures for cooling by 300 kJ are shown in the table below.

Cooling mixtures
Weights for cooling by 300 kJ

| Name | Formula | Heat of solution, kJ/kg | Necessary weight of salt, kg | Necessary quantity of water, kg | Total weight |
|---|---|---|---|---|---|
| Ammonium nitrate | $NH_4NO_3$ | 321.28 | 0.93 | 0.8 | 1.73 |
| Ammonium chloride | $NH_4Cl$ | 184.87 | 1.62 | 4.3 | 5.92 |
| Potassium chloride | KCl | 232.78 | 1.29 | 5.4 | 6.49 |
| Common salt | NaCl | 66.98 | 4.48 | 12.5 | 17.03 |

The available cooling energy shall be determined in a numerical example. When taking, for example, 1.09 kg of ammonium nitrate with the corresponding necessary quantity of water, equaling 0.9 kg, i.e., a total weight of about 2 kg, a cooling energy of 350 kJ is obtained. Experiments have shown that the air temperature in the interior space of the safety suit can thus be lowered by 4° C. compared to the uncooled state over the entire mission time of 20 minutes.

One or more units of salt containers, in which the salt can be stored in the dry state, would be provided for cooling in the safety suit.

Besides, one or more water containers, which are connected by a valve to the salt containers, would be arranged. In case of a mission, the user of the suit can simply switch on the air delivery device and open the valve. This may also happen automatically or electronically. The valve may also be actuated in a cycled manner or proportionally in order to regulate the cooling effect. However, the full cooling capacity is required in the normal case because the ambient temperature is too high. By contrast, a regulating means can delay the feed of water and thus either turn off or reduce the cooling effect at cold ambient temperatures.

The salt containers are provided with heat exchanger ribs and are designed such that they have a maximum surface for the air flowing past in order to make the cooling capacity as effective as possible. The air delivery device, power supply unit and cooling device are fastened to a mounting plate, which is arranged on the back of the user of the suit, and a mounting plate already present of a compressed air breathing apparatus may also be used to fix the cooling device thereto.

A cooling capacity in the range of 500 L per minute to 1,000 L per minute is necessary according to the present invention for a forced air circulation within the safety suit with one or more fans in order to achieve good, thorough ventilation of the safety suit. If the cooling device is on the back of the user of the suit, the air discharge opening of the air delivery device is directed towards the head of the user of the suit, so that the air flow, starting from the head, first sweeps over the visor, which is very well ventilated and also cooled as a result. The air flow then reaches the lower area of the safety suit.

The gas drawn in by the air delivery device flows at first over the heat exchanger ribs and is cooled in the process before it is circulated again.

If the existing mounting plate of a respirator is used as the bracket for the cooling device, the cooling device can be fastened to the pressurized gas cylinder with simple Velcro fasteners, so that the cooling device can be optionally operated practically with any respirator if the user of the respirator uses a safety suit. In addition to the weight of the respirator, the user of the suit must carry along an additional weight of about 500 g for the air delivery device and 2 kg for the salt and water, so that there is an extra load of 2.5 kg on the whole. This additional weight is normally acceptable.

The process according to the present invention for cooling the interior space of a safety suit is characterized by the following steps:

providing an air delivery device providing an air volume flow for circulating air in the interior space;

providing a cooling source with a heat exchanger arranged in the air flow and with a reservoir connected to the heat exchanger;

providing a substance reacting endothermically with water, the substance being provided in the reservoir;

setting the air delivery device to circulate the air of the interior space to an air volume flow between 500 L per minute and 1,000 L per minute; and passing the air volume flow over the cooling source to cool the air by means of the substance reacting endothermically with water. The cooling is provided by the substance reacting endothermically with water.

An exemplary embodiment of the present invention is shown in the figures and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
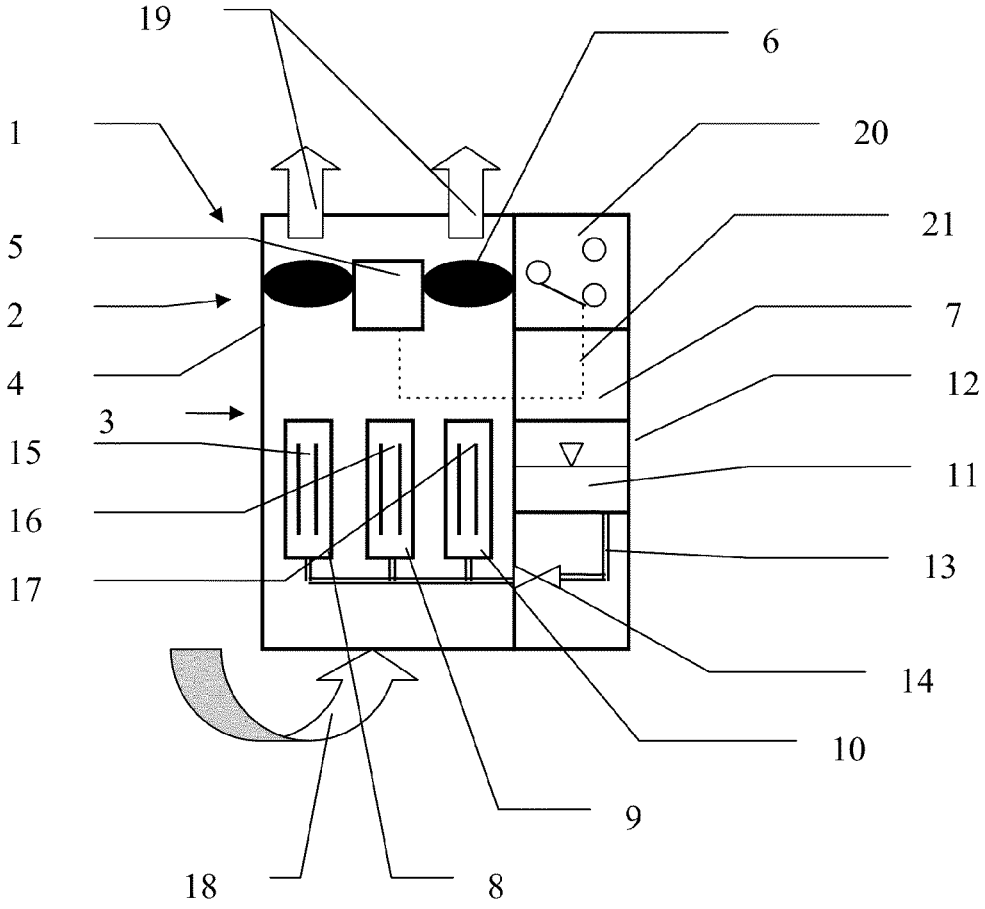
FIG. 1 is a schematic view of a cooling device according to the invention.

Referring to the drawings in particular, FIG. 1 shows a cooling device 1 for the interior space of a safety suit, not shown in greater detail, comprising an air delivery device 2 and a cooling source 3, which are arranged on a mounting plate.

The air delivery device 2 comprises an electric motor 5 with a fan wheel 6 and a power source 7, while the cooling source 3 comprises three reservoirs 8, 9, 10 filled with ammonium nitrate, a container 12 filled with water 11 and a connection line 13 with a shut-off valve 14 between the container 12 and the reservoirs 8, 9, 10. The reservoirs 8, 9, 10 have heat exchanger ribs 15, 16, 17, which are located in the intake area of the air delivery device 2. The direction of air flow is indicated by arrows 18, 19. Furthermore, an electric switch 20, which is connected to the electric motor 5 and to the shut-off valve 14 via lines 21, is fastened to the mounting plate 4. When the electric motor 5 is switched on by switch 20, the shut-off valve 14 opens at the same time, so that water 11 enters the reservoirs 8, 9, 10.

Figure 2:
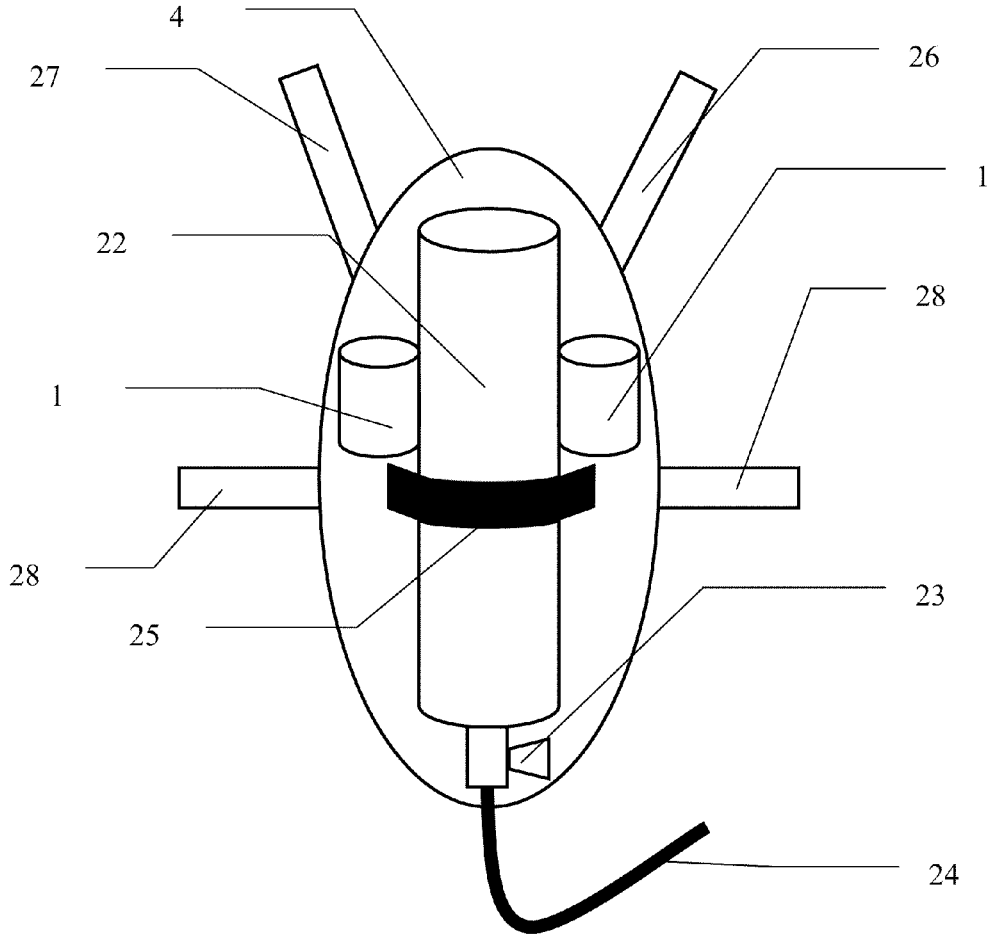
FIG. 2 is a schematic view of the cooling device according to FIG. 1 with a compressed gas cylinder.

FIG. 2 shows the mounting plate 4 with the cooling device 1 and with a centrally arranged compressed gas cylinder 22 for operating a respirator, not shown in greater detail. The compressed gas cylinder 22 has a cylinder valve 23 for connecting a compressed gas supply tube 24. The compressed gas cylinder 22 is fastened to the mounting plate 4 by means of a holding belt 25. The mounting plate is arranged on the back of a user of the safety suit, not shown in more detail, by means of two shoulder belts 26, 27 and a lap belt 28.

Figure 3:
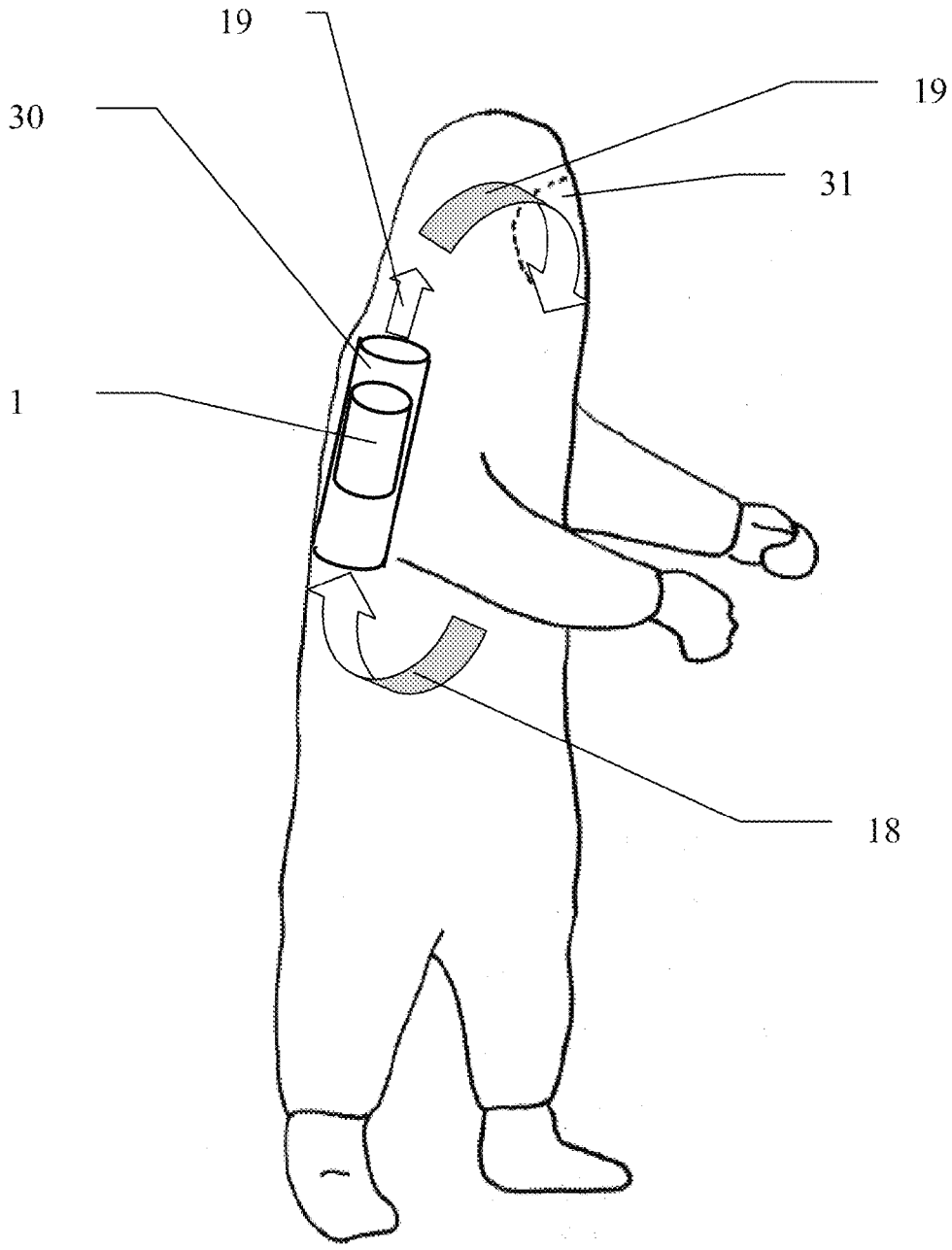
FIG. 3 is a schematic view showing the cooling device according to FIG. 1 in a safety suit.

FIG. 3 schematically shows the arrangement of the cooling device 1 within a safety suit 29. The air discharge opening 30 of the cooling device 1 is directed towards the head of the user of the suit, so that the cooled air, passing over the head, first reaches the visor 31 of the safety suit 29 and prevents fogging there.

While specific embodiments of the invention have been described in detail to illustrate the application of the principles of the invention, it will be understood that the invention may be embodied otherwise without departing from such principles.

Appendix

| List of Reference Numbers | |
|---|---|
| 1 | Cooling device |
| 2 | Air delivery device |
| 3 | Cooling source |
| 4 | Mounting plate |
| 5 | Electric motor |
| 6 | Fan wheel |
| 7 | Power source |
| 8, 9, 10 | Reservoir |
| 11 | Water |
| 12 | Container |
| 13 | Connection line |
| 14 | Shut-off valve |
| 15, 16, 17 | Heat exchanger ribs |
| 18, 19 | Arrow |
| 20 | Switch |
| 21 | Line |
| 22 | Compressed gas cylinder |
| 23 | Cylinder valve |
| 24 | Compressed gas supply tube |
| 25 | Holding belt |
| 26, 27 | Shoulder belt |
| 28 | Lap belt |
| 29 | Safety suit |
| 30 | Air discharge opening |
| 31 | Visor |

What is claimed is:

1. A device for cooling an interior space of a safety suit, the device comprising:

an air delivery device providing an air volume flow for circulating air in the interior space;

a cooling source with a heat exchanger arranged in the air volume flow and with a reservoir connected to the heat exchanger;

a container;

a connection line with a valve, provided between said container and the reservoir, said connection line being closed or opened by said valve;

water, wherein said water is contained in said container and is separated from the substance by said connection line with said valve; and a substance reacting endothermically with the water, said substance being provided in said reservoir.

2. A device for cooling in accordance with claim 1, wherein the substance consists essentially of one of ammonium nitrate, ammonium chloride, potassium chloride and common salt.

3. A device for cooling in accordance with claim 1, wherein the air volume flow of the air delivery device is set at a value between 500 L per minute and 1,000 L per minute.

4. A device for cooling an interior space of a safety suit, the device comprising:

an air delivery device providing an air volume flow for circulating air in the interior space;

a cooling source with a heat exchanger arranged in the air volume flow and with a reservoir connected to the heat exchanger;

a substance reacting endothermically with water, said substance being provided in said reservoir; and a mounting plate for fastening on the back of a user of the suit, the air delivery device and the cooling source being arranged on said mounting plate.

5. A device for cooling in accordance with claim 4, further comprising a respirator compressed gas cylinder fastened to said mounting plate.

6. A device for cooling in accordance with claim 1, wherein an air discharge opening of said air delivery device is directed towards the head of the user of the suit.

7. A process for cooling an interior space of a safety suit, the process comprising the steps of:

providing an air delivery device providing an air volume flow for circulating air in the interior space;

providing a cooling source with a heat exchanger arranged in the air volume flow and with a reservoir connected to the heat exchanger;

providing a container;

providing water in the container;

providing a substance reacting endothermically with the water, the substance being provided in the reservoir;

providing a connection line with a valve between the container and the reservoir, said connection line being closed or opened by the valve;

using the connection line with the valve to control contact between the substance and the water;

setting the air delivery device to circulate the air of the interior space to an air volume flow between 500 L per minute and 1,000 L per minute; and passing the air volume flow over the cooling source to cool the air by means of the substance reacting endothermically with water.

8. A process for cooling in accordance with claim 7, wherein the substance consists essentially of one of ammonium nitrate, ammonium chloride, potassium chloride and common salt.

9. A process for cooling an interior space of a safety suit, the process comprising the steps of:

providing an air delivery device providing an air volume flow for circulating air in the interior space;

providing a cooling source with a heat exchanger arranged in the air volume flow and with a reservoir connected to the heat exchanger;

providing a substance reacting endothermically with water, the substance being provided in the reservoir;

setting the air delivery device to circulate the air of the interior space to an air volume flow between 500 L per minute and 1,000 L per minute;

passing the air volume flow over the cooling source to cool the air by means of the substance reacting endothermically with water; and providing a mounting plate for fastening on the back of a user of the suit, and arranging the air delivery device and the cooling source on the mounting plate.

10. A process for cooling in accordance with claim 9, further comprising providing a respirator compressed gas cylinder fastened to the mounting plate.

11. A process for cooling in accordance with claim 7, wherein an air discharge opening of the air delivery device is directed towards the head of the user of the suit.

12. A safety suit system comprising:

a safety suit defining a suit interior space; and a device for cooling the interior space of the safety suit, the device comprising an air delivery device providing an air volume flow circulating in the interior space, a cooling source with a heat exchanger arranged in the air volume flow and with a reservoir connected to the heat exchanger, and a substance reacting endothermically with water, said substance being provided in said reservoir.

13. A safety suit system in accordance with claim 12, wherein the substance consists essentially of one of ammonium nitrate, ammonium chloride, potassium chloride and common salt.

14. A safety suit system in accordance with claim 12, further comprising:

a container;

a connection line with a valve, provided between said container and the reservoir, said connection line being closed or opened by said valve; and water, wherein said water is contained in said container and is separated from the substance by said connection line with said valve.

15. A safety suit system in accordance with claim 12, wherein the air volume flow of the air delivery device is set at a value between 500 L per minute and 1,000 L per minute.

16. A safety suit system in accordance with claim 14, further comprising a mounting plate for fastening on the back of a user of the suit, the air delivery device and the cooling source being arranged on said mounting plate.

17. A safety suit system in accordance with claim 15, further comprising a respirator compressed gas cylinder fastened to said mounting plate.

18. A safety suit system in accordance with claim 14, wherein an air discharge opening of said air delivery device is directed towards the head of the user of the suit.

* * * * *